US007220165B2

(12) United States Patent
Inagaki et al.

(10) Patent No.: US 7,220,165 B2
(45) Date of Patent: May 22, 2007

(54) BLASTING MATERIALS AND METHOD OF BLASTING

(75) Inventors: Yasuhito Inagaki, Kanagawa (JP); Tetsuya Komine, Kanagawa (JP); Masahiro Sawaguchi, Miyagi (JP); Daisuke Hasegawa, Miyagi (JP)

(73) Assignee: Sony Corporation, Tokyo (JP)

( * ) Notice: Subject to any disclaimer, the term of this patent is extended or adjusted under 35 U.S.C. 154(b) by 169 days.

(21) Appl. No.: 10/504,304

(22) PCT Filed: Feb. 12, 2003

(86) PCT No.: PCT/JP03/01433

§ 371 (c)(1),
(2), (4) Date: Aug. 11, 2004

(87) PCT Pub. No.: WO03/068452

PCT Pub. Date: Aug. 21, 2003

(65) Prior Publication Data

US 2005/0130564 A1 Jun. 16, 2005

(30) Foreign Application Priority Data

Feb. 12, 2002 (JP) ..... 2002-034607
Feb. 12, 2002 (JP) ..... 2002-034611
Mar. 29, 2002 (JP) ..... 2002-096980

(51) Int. Cl.
*B24B 1/00* (2006.01)
*B24C 1/00* (2006.01)

(52) U.S. Cl. ..... 451/36; 451/38; 451/39

(58) Field of Classification Search ..... 451/36, 451/38, 39

See application file for complete search history.

(56) References Cited

U.S. PATENT DOCUMENTS 2,479,299 A * 8/1949 Biggs et al. ..... 451/75
2,616,222 A * 11/1952 Russell ..... 451/75
4,409,920 A * 10/1983 Hammelmann ..... 114/222
4,828,893 A * 5/1989 Tallman ..... 428/41.9
5,107,629 A * 4/1992 Boyd et al. ..... 451/38
5,339,573 A * 8/1994 Uchida et al. ..... 451/92
6,126,513 A * 10/2000 Oshio et al. ..... 451/28
6,368,195 B1 * 4/2002 Oshio et al. ..... 451/88
6,634,576 B2 * 10/2003 Verhoff et al. ..... 241/21
6,659,844 B2 * 12/2003 Shaw ..... 451/30
7,017,371 B2 * 3/2006 Juul et al. ..... 65/134.8
2003/0083187 A1 * 5/2003 Juul et al. ..... 501/27
2004/0040174 A1 * 3/2004 Childs ..... 34/380
2005/0130564 A1 * 6/2005 Inagaki et al. ..... 451/38
2005/0145578 A1 * 7/2005 Childs ..... 210/768

FOREIGN PATENT DOCUMENTS

JP 2000-51634 2/2000
JP 2001-277124 10/2001
JP 2001-300851 10/2001
JP 2002-36252 2/2002

* cited by examiner

*Primary Examiner*—M. Rachuba
(74) *Attorney, Agent, or Firm*—Sonnenschein Nath & Rosenthal LLP

(57) ABSTRACT

It is an object of the present invention to provide a blasting method and a shot material, which are very practical both in the cost and the treatment performance.

(a) A shot material containing a styrene ion-exchange resin or a waste material caused therefrom, or/and a dried sludge-derived material, (b) a shot material containing a resin which is comprised of a resin containing a rubber component and a resin containing no rubber component, and (c) a shot material containing at least one component selected from the group consisting of an epoxy resin composition and inorganic filler, and a blasting method using the shot material.

5 Claims, No Drawings

BLASTING MATERIALS AND METHOD OF BLASTING

BACKGROUND OF THE INVENTION

The present invention relates to a shot material and a blasting method using the shot material.

Blast processing is used in a wide variety of fields for peeling a coating, such as a white line on the pavement, and removing other deposits, removing a deposit to a rubber mold, removing a deposit, such as paint, pollutant, rust, or surface oxide, deburring of a resin shaped article, or surface abrasion. Conventionally, as a shot material for use in the blast processing, particles made of various materials, such as alumina, glass, or a resin, have been utilized. Recently, from the viewpoint of reduction and recycle of waste for preventing environmental pollution, attempts are vigorously made to remove coating films in products disposed of (for example, metal materials and resin materials in automobiles and household appliances) by blasting treatment using the shot material to reuse them as raw materials. Therefore, various studies have been made on the shot material used in the blasting treatment (e.g., Japanese Patent Application Publication No. 2001-277123).

However, the blasting treatment for peeling the coating films in waste requires a great amount of the shot material, and therefore poses problems of costs for the material of the shot itself and for treating the used shot material. In addition, the shot material used for an object of reusing waste becomes another waste and hence the used shot material must be treated, antistatic properties must be imparted to the shot material for preventing it from adhering to the materials peeled, and safety must be secured for preventing an occurrence of dust explosion, and these problems of treatments for the shot material are the big hurdle that should be overcome for putting the shot material into practical use.

In view of the above problems accompanying the current techniques, an object of the present invention is to provide a blasting method and a shot material, which are very practical both in the cost and the treatment performance.

SUMMARY OF THE INVENTION

The present inventors have conducted extensive and intensive studies with a view toward solving the above-mentioned problems. As a result, it has been found that the use of, individually or in combination, (a) a shot material containing a styrene ion-exchange resin or a waste material caused therefrom, or/and a dried sludge-derived material, (b) a shot material containing a resin (C) which is comprised of a resin (A) containing a rubber component {heresinafter, frequently referred to simply as "resin (A)"} and a resin (B) containing no rubber component {heresinafter, frequently referred to simply as "resin (B)"}, and (c) a shot material containing an epoxy resin composition and inorganic filler is extremely effective in solution or improvement of the above problems, and the present invention has been completed.

Specifically, the present invention is directed to:

(1) a shot material characterized in that it contains a styrene ion-exchange resin or/and a dried sludge-derived material;

(2) the shot material according to item (1) above, characterized in that the styrene ion-exchange resin or/and the dried sludge-derived material are contained in an amount of 0.1% by weight or more;

(3) the shot material according to item (1) above, characterized in that the styrene ion-exchange resin is a waste material which has been used for a purpose;

(4) the shot material according to item (1) above, characterized in that the dried sludge-derived material contains 30% by weight or more of an inorganic component;

(5) the shot material according to item (1) above, characterized in that it further contains another shot material other than the styrene ion-exchange resin and the dried sludge-derived material; and (6) the shot material according to item (5) above, characterized in that the another shot material is at least one member selected from the group consisting of a thermosetting resin, a thermoplastic resin, a biodegradable polymer, a metal, a metal oxide, a metal hydroxide, a metal salt, ceramic, and carbon black.

Further, the present invention relates to:

(7) a blasting method characterized by using a shot material which contains a styrene ion-exchange resin or/and a dried sludge-derived material;

(8) the blasting method according to item (7) above, characterized in that the styrene ion-exchange resin or/and the dried sludge-derived material are contained in an amount of 0.1% by weight or mores in the shot material;

(9) the blasting method according to item (7) above, characterized in that the styrene ion-exchange resin is a waste material which has been used for a purpose;

(10) the blasting method according to item (7) above, characterized in that the dried sludge-derived material contains 30% by weight or more of an inorganic component;

(11) the blasting method according to item (7) above, characterized in that the shot material further contains another shot material other than the styrene ion-exchange resin and the dried sludge-derived material; and

(12) the blasting method according to item (11) above, characterized in that the another shot material is at least one member selected from the group consisting of a thermosetting resin, a thermoplastic resin, a biodegradable polymer, a metal, a metal oxide, a metal hydroxide, a metal salt, ceramic, and carbon black.

Further, the present invention relates to:

(13) an industrial product having a surface treated with a shot material which contains a styrene ion-exchange resin or/and a dried sludge-derived material;

(14) a method of reprocessing waste, characterized by conducting a blasting treatment using a shot material which contains a styrene ion-exchange resin or/and a dried sludge-derived material; and

(15) a reproduced product obtained by a method of reprocessing waste characterized by conducting a blasting treatment using a shot material which contains a styrene ion-exchange resin or/and a dried sludge-derived material.

Further, the present invention relates to:

(16) a blasting treatment method characterized by using a shot material which contains a resin (C) comprised of a resin (A) containing a rubber component and a resin (B) containing no rubber component;

(17) the blasting treatment method according to item (16) above, characterized in that at least one of the resin (A) containing a rubber component and the resin (B) containing no rubber component is a used resin;

(18) the blasting treatment method according to item (16) above, characterized in that the resin (C) is a used resin salvaged from a used magnetic recording product;

(19) the blasting method according to item (16) above, characterized in that the weight ratio of the resin (B)

containing no rubber component to the resin (A) containing a rubber component {(B)/(A)} is in the range of 0.001 to 5;

(20) the blasting method according to item (16) above, characterized in that the content of the resin (C) in the shot material is 0.1 to 100% by weight; and

(21) the blasting method according to item (16) above, characterized in that the resin (A) containing a rubber component is a HIPS (high impact polystyrene) and/or ABS (acrylonitrile/butadiene/styrene resin), and the resin (B) containing no rubber component is a PS (polystyrene) and/or AS (acrylonitrile/styrene resin).

Further, the present invention relates to:

(22) a shot material which contains a resin (C) comprised of a resin (A) containing a rubber component and a resin (B) containing no rubber component;

(23) the shot material according to item (22) above, characterized in that at least one of the resin (A) containing a rubber component and the resin (B) containing no rubber component is a used resin;

(24) the shot material according to item (22) above, characterized in that the resin (C) is a used resin salvaged from a used magnetic recording product;

(25) the shot material according to item (22) above, characterized in that the weight ratio of the resin (B) containing no rubber component to the resin (A) containing a rubber component {(B)/(A)} is in the range of 0.001 to 5; and

(26) the shot material according to item (22) above, characterized in that the content of the resin (C) in the shot material is 0.1 to 100% by weight.

Further, the present invention relates to:

(27) the shot material according to item (22) above, characterized in that the resin (A) containing a rubber component is a HIPS (high impact polystyrene) and/or ABS (acrylonitrile/butadiene/styrene resin), and the resin (B) containing no rubber component is a PS (polystyrene) and/or AS (acrylonitrile/styrene resin);

(28) an industrial product having a surface treated with a shot material which contains a resin (C) comprised of a resin (A) containing a rubber component and a resin (B) containing no rubber component;

(29) a method for reprocessing waste, characterized by conducting a blasting treatment using a shot material which contains a resin (C) comprised of a resin (A) containing a rubber component and a resin (B) containing no rubber component; and

(30) a reproduced product obtained by a method for reprocessing waste characterized by conducting a blasting treatment using a shot material which contains a resin (C) comprised of a resin (A) containing a rubber component and a resin (B) containing no rubber component.

Further, the present invention relates to:

(31) a shot material characterized in that it contains an epoxy resin composition and inorganic filler;

(32) the shot material according to item (31) above, characterized in that the epoxy resin composition and the inorganic filler are contained in an amount of 10% by weight or more;

(33) the shot material according to item (31) above, characterized in that the inorganic filler is contained in an amount 1 to 20 times the weight of the epoxy resin;

(34) the shot material according to item (31) above, characterized in that the epoxy resin composition is an epoxy resin composition for use in electric or electronic part;

(35) the shot material according to item (34) above, characterized in that the epoxy resin composition is a discarded material produced in an encapsulation step for the electric or electronic part;

(36) the shot material according to item (34) above, characterized in that the electric or electronic part is a semiconductor device; and

(37) the shot material according to item (31) above, characterized in that the inorganic filler contains 70% by weight or more of a silica component.

Further, the present invention relates to:

(38) a blasting method characterized by using a shot material which contains an epoxy resin composition and inorganic filler;

(39) the blasting method according to item (38) above, characterized in that the shot material contains 10% by weight or more of the epoxy resin composition and the inorganic filler;

(40) the blasting method according to item (38) above, characterized in that the shot material contains the inorganic filler in an amount 1 to 20 times the weight of the epoxy resin;

(41) the blasting method according to item (38) above, characterized in that the epoxy resin composition is an epoxy resin composition for use in electric or electronic part;

(42) the blasting method according to item (41) above, characterized in that the epoxy resin composition is a discarded material produced in an encapsulation step for the electric or electronic part;

(43) the blasting method according to item (41) above, characterized in that the electric or electronic part is a semiconductor device; and

(44) the blasting method according to item (38) above, characterized in that the inorganic filler contains 70% by weight or more of a silica component.

Further, the present invention relates to:

(45) an industrial product having a surface treated with a shot material which contains an epoxy resin composition and inorganic filler;

(46) a method for reprocessing waste, characterized by conducting a blasting treatment using a shot material which contains an epoxy resin composition and inorganic filler; and

(47) a reproduced product obtained by a method for reprocessing waste characterized by conducting a blasting treatment using a shot material which contains an epoxy resin composition and inorganic filler.

DETAILED DESCRIPTION OF THE PRESENTLY PREFERRED EMBODIMENT

As a shot material according to the first embodiment of the present invention, there can be mentioned a shot material characterized in that it contains a styrene ion-exchange resin or/and a dried sludge-derived material. The styrene ion-exchange resin has a cross-linked structure, and hence is preferable in mechanical strength and heat resistance (which are physical properties required for peeling films), and it has an ionic group and hence is a material having preferable antistatic effect (which is an effect to prevent the shot material from adhering to the materials peeled).

With respect to the type of the ionic group in the styrene ion-exchange resin, there is no particular limitation, but, generally, it is sulfonic acid or a salt thereof, or a quaternary ammonium salt. With respect to the amount of the ionic group introduced into the resin, there is no particular limitation, but, generally, it is 1 to 99 mol %. The styrene ion-exchange resin may be either a virgin material (which means an unused resin; this applies to the following) or a waste material which has been used for a purpose. The used waste material includes discarded materials and defectives discharged from a plant. From the viewpoint of effective utilization of resources and reduction of waste, it is more preferred that a used waste material is used. The styrene ion-exchange resin used in the present invention may be a mixture of a virgin material and a used waste material.

It is especially preferred that the styrene ion-exchange resin contained in the shot material of the present invention is in the form of particles. With respect to the form of the styrene ion-exchange resin particles, there is no particular limitation, and the particles may have various forms, such as a spherical form, a long spherical form, a needle-like form, and a scale-like form. Of these, from the viewpoint of obtaining preferable impact resistance of the particles, uniform abrasive effect, and the like, it is preferred that part more than half of the particles are in a spherical form or a long spherical form. In the present invention, the spherical form or long spherical form means that the projected view or plan view of the particle has a circular form, an elliptic form, an extended circular form, a peanut form, or an egg form, which is more preferred than particles having an angular or indefinite form. In the present invention, the styrene ion-exchange resin is generally used in a state such that it is swelled with water, but the resin may be either used as it is as a shot material or used in a state of being frozen or dried as a shot material. Especially when used in a state of being dried or frozen, more preferable blasting effect is expected.

In the present invention, with respect to the method for forming particles of the styrene ion-exchange resin, there is no particular limitation, and examples include a method in which particles are formed from mass or pellets of the styrene ion-exchange resin using a known crusher or a known grinder, such as a ball mill or a grinding mill. The particle size of the ion-exchange resin used in the blasting treatment is generally about 0.0001 to 10 mm, especially, more preferably about 0.005 to 5 mm. Examples of methods for adjusting the particle size included a method in which the ion-exchange resin is classified before or after drying or freezing, and a method in which the ion-exchange resin is ground by means of a grinder or the like and then classified. A standard for the classification cannot be generally specified since it varies depending on the use, but it is preferred that about 70% by weight or more of the total weight falls in the range of about ±20% of the average particle size. The classification may be either a dry process or a wet process.

With respect to the sludge for the dried sludge-derived material contained in the shot material of present invention, there is no particular limitation, but sludge containing an inorganic component in a large amount is desired. Examples of inorganic components include metal salts, metal oxides, and metal hydroxides of Ca, Al, Si, Fe, Mg, Ti, Na, K, or Cu. Examples of metal salts include carbonates, halide salts including hydrochlorides, sulfates, phosphates, nitrates, acetates, and borates. It is desired that the content of the inorganic component in the dried sludge is 30% by weight or more.

The above sludge can be obtained from construction wastewater treatment, plant wastewater treatment, water treatment, or sewage treatment, but, generally, the sludge obtained from sewage treatment contains a large amount of an organic component and therefore, it is more desired that sludge other than this is used. Particularly, sludge discharged from a fabrication plant or assembling plant of semiconductor, (liquid crystal) substrate, or cathode ray tube has a single formulation and contains a large amount of an inorganic component and hence is more preferred as the shot material. Generally, the sludge is dried by heating in incineration or by means of a kiln, and then buried or mixed into cement, but, in the present invention, the dried material obtained from the sludge is used as a shot material for use in blasting treatment. The dried sludge-derived material used in the present invention can be obtained by a known treatment. For example, the sludge is made to coagulate and settle naturally or by means of a chemical, such as a coagulant, or a mechanical means, such as pressing or centrifuging. The sludge which coagulates and settles can be obtained by filtration and drying if desired. As a method for drying the sludge containing moistures in addition to the above-mentioned incineration or kiln treatment, any drying method including sun-drying, freeze-drying, hot-air drying, and vacuum drying may be used.

The dried sludge-derived material may be either used as it is as a shot material or adjusted to have a predetermined particle size. With respect to the particle size, there is no particular limitation, but the particle size is generally about 0.0001 to 10 mm, more preferably about 0.005 to 5 mm. As a method for adjusting the particle size of the dried sludge, the particle size may be adjusted before drying, or the dried sludge may be ground by means of a grinder, such as a ball mill or a grinding mill, and then classified. A standard for the classification cannot be generally specified since it varies depending on the use, but it is preferred that about 70% by weight or more of the total weight falls in the range of about ±20% of the average particle size. The classification may be either a dry process or a wet process.

In the shot material according to the above embodiment of the present invention, for obtaining satisfactory peel effect for coat film in the blasting treatment, the styrene ion-exchange resin or/and the dried sludge-derived material are contained in an amount of about 0.1% by weight or more, preferably about 1% by weight or more. When the shot material and another shot material described below in detail are used in combination, it is preferred that the amount of the styrene ion-exchange resin or/and the dried sludge-derived material falls in the above range.

The shot material according to the above embodiment of the present invention may contain individually the styrene ion-exchange resin and the dried sludge-derived material or both the styrene ion-exchange resin and the dried sludge-derived material in combination.

As a shot material according to the second embodiment of the present invention, there can be mentioned a shot material characterized in that it contains a resin (C) comprised of a resin (A) containing a rubber component {heresinafter, frequently referred to simply as "resin (A)"} and a resin (B) containing no rubber component {heresinafter, frequently referred to simply as "resin (B)"}.

With respect to the resin (A) containing a rubber component in the present invention, there is no particular limitation, and examples include ABS (acrylonitrile/butadiene/styrene) resins, HIPS (high impact polystyrene) resins, and alloys of the above resin and another resin. With respect to the alloy, there is no particular limitation as long as it is a resin compatible with ABS and/or HIPS, but, generally, alloys, such as ABS/PC (polycarbonate), ABS/PET (polyethylene terephthalate), ABS/PVC (polyvinyl chloride), ABS/PPE (polyphenylene ether), ABS/PSF (polysulfone), ABS/PBT (polybutylene terephthalate), ABS/nylon, and HIPS/PPE (polyphenylene ether), HIPS/PMMA (polymethylmethacrylate), and HIPS/polyolefin, are typical. In the used resin waste material in the present invention, these resins may be contained individually or a mixture of the two or more resins may be contained. When the resin (A) containing a rubber component is contained in the shot material, the toughness of the shot material particles is improved in the blasting treatment, so that the amount of dust generated during the blasting treatment is reduced.

With respect to the resin (B) containing no rubber component in the present invention, there is no particular limitation, and examples include AS, PS, PC, PET, PVC, PPE, PSF, PBT, nylon, PMMA, and polyolefin. Of these, preferred are AS and PS. When the resin (B) containing no rubber component is contained in the shot material, the hardness of the shot material becomes appropriate, so that a deposit, such as a coating, can be efficiently removed without causing no or almost no damage on the surface of a material to be blasted (e.g., a resin product).

Each of the above-mentioned resin (A) containing a rubber component and resin (B) containing no rubber component can be easily produced, and ones commercially available for various grades, such as general-purpose, high-stiffness, high-impact, wear-resistance, high-sliding, heat-resistance, transparence, high-luster, chemical-resistance, and coating grades, may be used. Alternatively, the resins may be ones which are not commercially available but produced in a resin plant. The resins (A) and (B) may contain various additives for resin, such as an antistatic agent, a coloring agent, a pigment, an antioxidant, a flame retardant, a plasticizer, a light resistance accelerator, a compatibilizer, a surface treating agent, a modifier, a coloring agent (e.g., carbon black), glass fiber, paper, and non-woven fabric.

As the resin (C) comprised of the resin (A) containing a rubber component and the resin (B) containing no rubber component, either the resins may be mixed together or a mixture of the resins may be used. Specifically, in the resin (C), either the resin (A) and the resin (B) may be individually in an independent form (particles, pellets, or mass), or the resin (A) and the resin (B) may be mixed with each other in a molten state. When using a virgin material (which means an unused resin; this applies to the following), these resins are mixed and can be used as a shot material. When using a used waste material, either resins separately salvaged may be mixed together or a mixture of the resins may be used. As the used resin salvaged from used waste materials, all kinds of resin waste materials which have been used in electrical appliances, office appliances, vehicles, and miscellaneous goods can be used. As the used resin, ones discharged in a fabrication plant as discarded materials of runner materials and raw material pellets may be used. The used resins generated in a plant and those salvaged from the standardized products (which are the same product or belong to the same product group) generally have consistent physical properties, and therefore they are more preferred from the viewpoint of reuse. Examples of the standardized products include recording media related products (videocassette shell), more specifically, videocassette for professional use and 8 mm videocassette and DV cassette for consumer use, household game machine (controller), and portable phone. Especially, in the present invention, it is preferred that the resin (C) is a used resin salvaged from a used magnetic recording product. With respect to the magnetic recording product, there is no particular limitation, and examples include the above-mentioned videocassettes and music tape cassettes. The magnetic recording product includes not only a magnetic recording medium but also a housing for protecting it, such as a casing and a shell.

In these products, generally, for improving the impact resistance of the products, the resin (A) containing a rubber component is used. On the other hand, the resin (B) containing no rubber component, such as a PS or AS resin, is frequently used as a window material or a casing material (transparent) in the products. When the used resins are surely separated from one another, the individual resins salvaged { the resin (A) and the resin (B)} are mixed together and can be used as a shot material, but, when the resin (A) and the resin (B) are contained mixed in a product, such as a cassette casing, both the resins are contained in the resin salvaged. In this case, it is preferred that the weight ratio of the resin (B) to the resin (A) {(B)/(A)} is in the range of about 0.001 to 5. When the weight ratio is not in the above range, it is preferred to make up for a lack of the resin (A) or resin (B) so that the weight ratio of the resin (B) to the resin (A) falls within the above range. When the individual resins (which may be used resins) are mixed together and used, it is more preferred that the resins are mixed in the above ratio and used as a shot material. It is more preferred that the content of the resin (C) comprised of the resin (A) and the resin (B) in the shot material is about 0.1 to 100% by weight. For suppressing the amount of dust generated during the blasting treatment and preventing the blasted surface from suffering a damage, it is preferred that the resin (C) content falls in the above range. The resin (C) content is similar when another shot material described below in detail is contained.

It is especially preferred that the resin (A), the resin (B), or a mixed resin of the resin (A) and the resin (B) contained in the shot material of the present invention is in the form of particles. With respect to the form of the particles, there is no particular limitation, and the particles may have various forms, such as a spherical form, a long spherical form, a needle-like form, and a scale-like form. Of these, from the viewpoint of obtaining preferable impact resistance of the particles, uniform abrasive effect, and the like, it is preferred that part more than half of the particles a resin a spherical form or a long spherical form. In the present invention, the spherical form or long spherical form means that the perspective view or plan view of the particle has a circular form, an elliptic form, an extended circular form, a peanut form, or an egg form, which is more preferred than particles having an angular or indefinite form. With respect to the particle size of the particles, there is no particular limitation, but the particle size is generally about 0.0001 to 10 mm, more preferably about 0.005 to 5 mm.

With respect to the method for forming the particles, there is no particular limitation, and examples include a method in which particles are formed from mass or pellets of the resin using a known crusher or a known grinder, such as a ball mill or a grinding mill. The resin (A), the resin (B), or a mixed resin of the resin (A) and the resin (B) may be either ground by means of a grinder and then used as a shot material, or ground and then classified into a predetermined particle size and used. A standard for the classification cannot be generally specified since it varies depending on the use, but it is preferred that about 70% by weight or more of the total weight falls in the range of about ±20% of the average particle size. The classification may be either a dry process or a wet process.

Further as a shot material according to the third embodiment of the present invention, there can be mentioned a shot material characterized in that it contains an epoxy resin composition and inorganic. As the epoxy resin used as the shot material in the present invention, preferred are compounds having two or more epoxy groups, including epoxy resins used in applications of electric use, coating, civil engineering, adhesive, and composite material, and there is no particular limitation. Of these, more preferred are those used as epoxy resins for electric use and composite material. Among the epoxy resins for electric use and composite material, more preferred are epoxy resins used in IC encapsulation materials and printed boards. The epoxy resin may be any type, such as bisphenol A type, brominated bisphenol A type, phenolic novolak type, cresol novolak type, alicyclic type, heterocyclic type, and flexible epoxy, but, especially, more preferred are cresol novolak type and phenolic novolak type epoxy resins.

In the epoxy resin, generally, as a curing agent, one having two or more functional groups for curing the epoxy resin is used. The epoxy resin composition used in the present invention may contain a curing agent as well as the above epoxy resin. As examples of curing agents, there can be mentioned phenolic compounds and amine compounds. In addition to the curing agent, an additive, such as a surface treating agent, a curing catalyst, a flame retardant (e.g., a halogen compound or a phosphorus compound), a flame retardant auxiliary (e.g., an antimony compound or a nitrogen compound), a coloring agent, an ion-capturing agent, anelastomer, or a wax, maybe contained in the epoxy resin composition. As preferred examples of the epoxy resin compositions used in the present invention, there can be mentioned epoxy resin compositions for use in electric or electronic part. Especially, as the epoxy resin composition used in the present invention, more preferred are discarded materials produced in an encapsulation step for the electric or electronic part.

With respect to the inorganic filler used in the shot material according to the above embodiment of the present invention, there is no particular limitation, and examples include crystalline silica, fused silica, calcium carbonate, magnesium carbonate, alumina, magnesia, talc, clay, calcium silicate, titanium oxide, asbestos, glass fiber, calcium fluoride, calcium sulfate, and calcium phosphate. In the present invention, a plurality of these inorganic filler may be used in combination. Of these, more preferred is inorganic filler comprised mainly of silica. In the inorganic filler comprised mainly of silica, it is more preferred that the inorganic filler contains about 70% by weight or more of a silica component. The inorganic filler may be contained in an amount about 1 to 20 times, preferably about 2 to 5 times the weight of the epoxy resin.

The above-described epoxy resin and inorganic filler maybe present either independently or in the form of a composite material containing both the epoxy resin and the inorganic filler, such as an encapsulation material for electric or electronic part, or an epoxy substrate material. In the former, generally, the epoxy resin and the inorganic filler are mixed together by a known method to form the shot material of the present invention. In the latter, either the composite material may be used as it is as a shot material, or the epoxy resin or inorganic filler maybe further added to the composite material. In the shot material of the present invention, a discarded material (e.g., a runner material, a non-standardized product, mold flash or the like) discharged in a plant may be used, or a used waste material salvaged from the market (e.g., an IC chip, a printed board or the like) may be used. From the viewpoint of effective utilization of resources and reduction of waste, it is more preferred to use a used waste material or a discarded material generated in a plant.

It is especially preferred that the epoxy resin, the inorganic filler, or a mixture of the epoxy resin and the inorganic filler contained in the shot material of the present invention is in the form of particles. With respect to the form of the particles, there is no particular limitation, and the particles may have various forms, such as a spherical form, a long spherical form, a needle-like form, and a scale-like form. Of these, from the viewpoint of obtaining preferable impact resistance of the particles, uniform abrasive effect, and the like, it is preferred that part more than half of the particles a resin a spherical form or a long spherical form. In the present invention, the spherical form or long spherical form is as defined above. When the epoxy resin, the inorganic filler, or the mixture of the epoxy resin and the inorganic filler is in the form of particles, with respect to the particle size of the particles, there is no particular limitation, but the particle size is generally about 0.0001 to 10 mm, generally, more preferably about 0.005 to 5 mm. With respect to the method for forming particles of the epoxy resin, the inorganic filler, or the mixture of the epoxy resin and the inorganic filler, there is no particular limitation, and examples include the above-mentioned methods for forming particles, such as a method in which particles are formed from mass or pellets of the resin, or a used waste material or a discarded material generated in a plant using a known crusher or a known grinder, such as a ball mill or a grinding mill.

In the present invention, the above-described (a) shot material containing a styrene ion-exchange resin or a waste material caused therefrom, or/and a dried sludge-derived material, (b) shot material containing a resin (C) which is comprised of a resin (A) containing a rubber component and a resin (B) containing no rubber component, and (c) shot material containing an epoxy resin composition and inorganic filler may be used individually or in combination. Further, another shot material may be mixed into each of the shot materials (a) to (c) or the combination of theses hot materials. As the another shot material, a conventional shot material may be used, and examples include organic polymer shot materials and inorganic (metal, ceramic) shot materials.

Examples of organic polymer shot materials include melamine resins, urea resins, phenolic resins, ketone resins, epoxy resins, guanamine resins, urea resins, unsaturated polyester resins, polycarbonate resins, acrylic resins, polyamide resins, polyphenolic resins, polyester resins, polystyrene resins, ABS (acrylonitrile-butadiene-styrene) resins, AS (acrylonitrile-styrene) resins, PAN (polyacrylonitrile) resins, POM (polyacetal) resins, PPE (polyphenylene ether), PEO (polyethylene oxide), AES {facrylonitrile-(ethylene-propylene rubber)-styrene}, AAS (acrylonitrile-acrylate-styrene), EVA (ethylene-vinyl acetate copolymer), butadiene resins, vinyl acetate resins, methacrylic resins, polysulfone resins, cellulose, polyurethane resins, biodegradable resins (such as chitin, chitosan, polylactic acid, polyvinyl alcohol, and polyamino acid), polyacrylamide, polycarboxylate ester, polyaminoethyl acrylate salts, and sodium polystyrenesul fonate. The organic polymer shot material may be either a virgin material or a waste material which has been used for a purpose. Especially, from the viewpoint of effective utilization of resources and reduction of waste, it is more preferred to use a blend of the organic polymer shot material comprised of a used waste material as a raw material and the shot material of the present invention.

Examples of inorganic (metal, ceramic) shot materials include steel particles, zinc particles, aluminum particles, alumina, silica, mica, carbon black, calcium carbonate, glass (fiber, balloon), titanium oxide, magnesium carbonate, talc, clay, and a variety of metal oxides, metal hydroxides, and metal salts. The inorganic shot material may be either a virgin material or a waste material which has been used for a purpose. Especially, from the viewpoint of effective utilization of resources and reduction of waste, it is more preferred to use a blend of the inorganic shot material comprised of a used waste material as a raw material and the shot material of the present invention.

In the present invention, by selecting or controlling the content of the shot material of the above three embodiments or the type or content of another shot material incorporated, the specific gravity, hardness and the like of the shot material can be appropriately selected or controlled depending on the form of the material to be blasted or the purpose of the blasting treatment. For example, the use of alumina, silica, or glass fiber having a high hardness as another shot material is preferred in a relatively hard blasting treatment. On the other hand, the use of, for example, calcium carbonate, magnesium carbonate, talc, or clay having a low hardness as another shot material is preferred in a relatively soft blasting treatment. The use of glass balloon is preferred when lowering the specific gravity of the shot material. When carbon black is incorporated, conductivity can be imparted to the shot material, making it possible to more effectively prevent the shot material from being charged. Incorporation of an organic shot material can advantageously improve the shot material in toughness.

The shot material of the present invention may contain a known additive. For example, when iron oxide in a spherical form, a shattered form, or a fibrous form or a compound containing iron oxide (e.g., ferrite) is incorporated, the shot material can be prevented from being electrostatically charged during the grinding step for granulation of the shot material or during the blasting. When a pigment containing iron oxide or a compound containing iron oxide (e.g., ferrite), specifically, $\alpha$FeOOH, $\beta$FeOOH, $\gamma$FeOOH, $\alpha Fe_2O_3$, $\gamma Fe_2O_3$, $Fe_3O_4$, $MoFe_2O_3$, $Mo_6Fe_2O_3$, or the like is incorporated, the shot material can be colored and identified by color, leading to an advantage in handling or control of the products.

With respect to the amount of the additive incorporated, there is no particular limitation, and it cannot be generally specified since it varies depending on the type or purpose of use of the additive. For example, when the above-mentioned pigment containing iron oxide or a compound containing iron oxide (e.g., ferrite) is incorporated as an additive, the amount of the pigment incorporated varies depending on the purpose of incorporation, but it is preferably about 10% by weight or less, especially preferably about 0.001 to 1% by weight.

The present invention provides a blasting method using the above-described novel shot material. With respect to the blasting method, there is no particular limitation, and, for example, an impeller having a plurality of rectangular plates radially provided on a rotary shaft is rotated at a high speed to achieve centrifugal shot of the shot material of the present invention, or the shot material of the present invention is shot by an air nozzle using compressed air. In shot of the shot material of the present invention, a medium, such as water or air, may be either used or not used. It is especially preferred that the shot material of the present invention is shot using gas as a medium.

As a preferred embodiment of the blasting method of the present invention, there can be mentioned a method in which the shot material of the present invention is sprayed, together with a gas stream. As the above method, various types of blasting methods can be used, but a dry blasting method is more preferred. Examples of dry blasting methods include: (1) a gravity blasting method in which powder is placed in a tank at a position higher than a nozzle, and the powder which falls by gravity toward a discharge outlet formed in the bottom of the tank is shot through the nozzle, together with compressed gas; (2) a direct blasting method in which a powder pressure feed tank is packed with powder and compressed gas is fed into the tank, and the powder discharged from a discharge outlet formed in the bottom of the tank is shot through a nozzle, together with the compressed gas; and (3) a siphon blasting method in which powder is placed in a tank at a position lower than a nozzle, and the powder discharged by suction of compressed gas from a discharge outlet formed in the bottom of the tank is shot through the nozzle, together with the compressed gas, and any of these blasting methods can be used.

In the above methods, as compressed gas, generally, compressed air is used but, for avoiding dust explosion, inert gas, such as nitrogen, may be used. In the blasting treatment, the powder amount, the pressure of compressed gas, and the shot speed and time can be appropriately selected according to the type of the powder used or the type or deposit state of the material to be peeled (coat film).

When conducting the above-mentioned blasting treatment, the temperature of an object to be treated may be room temperature, but it is preferred that the object to be treated is preheated. The heating temperature cannot be generally specified since it varies depending on the type of the object to be treated, but it is preferred to set the heating temperature at such a high temperature that the quality of the object to be treated does not deteriorate.

The shot material of the present invention which has been used in the blasting treatment can be recovered and separated from deposit substances using a conventional. after-treatment equipment, such as a cyclone, and reused. The shot material having deposit substances mixed can be either reused as a shot material by incineration treatment or blended with cement and buried. From the viewpoint of effective utilization of resources, it is more preferred that the used shot material is reused as a shot material after incineration or blended with cement.

The blasting method of the present invention can be used in a variety of applications. For example, the blasting method of the present invention is advantageously used for removing a coating. With respect to the coating, there is no particular limitation, and examples include a vinyl chloride coating, an urethane coating, and an acryl coating. With respect to the coated article, there is no particular limitation, and examples include resin shaped articles and wooden articles. With respect to the resins haped article, there is no particular limitation, and examples include a bumper, an instrument panel or a dashboard of automobile, or a pleasure boat. In addition, the blasting method of the present invention can be used for peeling a coating, such as a white line on the pavement. The blasting method of the present invention can be used for deburring of a metal cast article or a resin shaped article or for cleaning and polishing surface. Further, the blasting method of the present invention can be used for removing deposits, removing a deposit to a rubber mold, or removing pollutant, rust, or surface oxide.

Heresinbelow, the present invention will be described in more detail with reference to the following Examples, which should not be construed as limiting the scope of the present invention.

EXAMPLE 1

Using as a shot material a dried material (particle size after grinding treatment: 500 to 850 μm) formed from a cation-exchange resin discharged from a liquid crystal plant, a used CD film (acryl-coated Al film) was subjected to peel treatment by means of a direct-pressure sandblasting machine for 10 seconds, and the surface state (peel area) was measured.

EXAMPLE 2

A used CD film was subjected to blasting treatment in substantially the same manner as in Example 1 except that a dried material (particle size after grinding treatment: 500 to 850 μm) formed from an anion-exchange resin discharged from a semiconductor plant was used as a shot material.

EXAMPLE 3

A used CD film was subjected to blasting treatment in substantially the same manner as in Example 1 except that a dried material formed from a commercially available cation-exchange resin (Amberlite IR124Na; particle size after grinding treatment: 500 to 850 μm) was used as a shot material.

EXAMPLE 4

A used CD film was subjected to blasting treatment in substantially the same manner as in Example 1 except that a dried material formed from a commercially available anion-exchange resin (Amberlite IRA402BL; particle size after grinding treatment: 500 to 850 μm) was used.

EXAMPLE 5

A used CD film was subjected to blasting treatment in substantially the same manner as in Example 1 except that a commercially available resin shot material (melamine-based; particle size: 500 to 850 μm) was blended in an amount of 60% with the dried cation-exchange resin material in Example 1.

EXAMPLE 6

A used CD film was subjected to blasting treatment in substantially the same manner as in Example 1 except that a commercially available resin shot material (nylon-based; particle size: 500 to 850 μm) was blended in an amount of 20% with the dried anion-exchange resin material in Example 4.

EXAMPLE 7

A used CD film was subjected to blasting treatment in substantially the same manner as in Example 1 except that a used ABS resin (cell waste from 8 mm videocassette; particle size: 500 to 850 μm) was blended in an amount of 30% with the dried cation-exchange resin material in Example 1.

COMPARATIVE EXAMPLE 1

A used CD film was subjected to blasting treatment in substantially the same manner as in Example 1 except that the commercially available resin shot material used in Example 5 was solely used.

COMPARATIVE EXAMPLE 2

A used CD film was subjected to blasting treatment in substantially the same manner as in Example 1 except that the commercially available resin shot material used in Example 6 was solely used.

The results of the above examples were compared and studied. As a result, it has been found that, in Comparative Examples 1 and 2, the peel area per unit period of time for the treatment is small and the amount of fine powder scattered is large, as compared to those in Examples 1 to 7. Further, it has been confirmed that, by blending the shot material of the present invention with a commercially available shot material or used resin waste, the peel effect is improved.

EXAMPLE 8

Using as a shot material a dried sludge-derived material (containing Al: 30% by weight, Ca: 25% by weight, and O: 35% by weight; particle size: 500 to 850 μm) discharged from a liquid crystal plant, a used CD film (acryl-coated Al film) was subjected to peel treatment by means of a direct-pressure sandblasting machine for 10 seconds, and the surface state (peel area) was measured.

EXAMPLE 9

A used CD film was subjected to blasting treatment in substantially the same manner as in Example 8 except that a dried sludge-derived material (containing Ca: 50% by weight, O: 10% by weight, and F: 20% by weight) discharged from a cathode ray tube plant was used as a shot material.

EXAMPLE 10

A used CD film was subjected to blasting treatment in substantially the same manner as in Example 8 except that a dried sludge-derived material (containing Si: 30% by weight, O: 35% by weight, Al: 15% by weight, and Ca: 10% by weight) discharged from a semiconductor plant was used as a shot material.

EXAMPLE 11

A used CD film was subjected to blasting treatment in substantially the same manner as in Example 8 except that a commercially available resin shot material (melamine-based; particle size: 500 to 850 μm) was blended in an amount of 70% with the dried sludge-derived material in Example 8.

EXAMPLE 12

A used CD film was subjected to blasting treatment in substantially the same manner as in Example 8 except that a commercially available resin shot material (nylon-based; particle size: 500 to 850 μm) was blended in an amount of 20% with the dried sludge-derived material in Example 9.

EXAMPLE 13

A used CD film was subjected to blasting treatment in substantially the same manner as in Example 8 except that a dried material (particle size: 500 to 850μm) formed from a used ion-exchange resin was blended in an amount of 80% with the dried sludge-derived material in Example 10.

EXAMPLE 14

A used CD film was subjected to blasting treatment in substantially the same manner as in Example 8 except that a used ABS resin (cell waste from 8 mm videocassette; particle size: 500 to 850 μm) was blended in an amount of 30% with the dried sludge-derived material in Example 8.

COMPARATIVE EXAMPLE 3

A used CD film was subjected to blasting treatment in substantially the same manner as in Example 8 except that the commercially available resin shot material used in Example 11 was solely used.

COMPARATIVE EXAMPLE 4

A used CD film was subjected to blasting treatment in substantially the same manner as in Example 8 except that the commercially available resin shot material used in Example 12 was solely used.

The results of the above examples were compared and studied. As a result, it has been found that, in Comparative Examples 3 and 4, the peel area per unit period of time for the treatment is small and the amount of fine powder scattered is large, as compared to those in Examples 8 to 14. Further, it has been confirmed that, by blending the shot material of the present invention with a commercially available shot material or used resin waste, the peel effect is improved.

In the following Examples 15 to 20 and Comparative Examples 5 and 6, individually using the samples shown below as a shot material, a used CD (acryl-coated Al film) was subjected to peel treatment for 10 seconds, and the surface state (peel area) was measured.

EXAMPLE 15

A resin salvaged from cassette cell for business purposes (material salvaged from a broadcasting station):

a mixture of: a shell body (top and bottom); ABS resin (95% by weight; high-flow high-stiffness grade) and a window of the shell (transparent portion); AS resin (5% by weight); which was ground and classified so that the particle size became 500 to 850 μm.

EXAMPLE 16

A mixture of an ABS resin (70% by weight; 500 to 850 μm) and an AS resin (30% by weight; 500 to 850 μm), which was obtained by classifying the resin pellet waste discharged from a resin molding plant.

EXAMPLE 17

A resin salvaged from VHS cassette cell:

a mixture of: a shell body (top and bottom); HIPS resin (97% by weight; high-flow high-stiffness grade) and a window (transparent) portion of the shell; PS resin (3% by weight); which was ground by means of a grinder so that the particle size became 500 to 850 μm.

EXAMPLE 18

A mixture of virgin resins:

a mixture of a ground/classified general-purpose high-impact grade ABS resin (40% by weight; 500 to 850 μm) and a ground/classified general-purpose GPPS resin (60% by weight; 500 to 850 μm).

EXAMPLE 19

The resin in Example 15 added 80% by weight of a commercially available resin shot material (melamine-based; particle size: 500 to 850 μm).

EXAMPLE 20

The resin in Example 17 added 60% by weight of a commercially available resin shot material (nylon-based; particle size: 500 to 850 μm).

COMPARATIVE EXAMPLE 5

The commercially available resin shot material used in Example 19.

COMPARATIVE EXAMPLE 6

The commercially available resin shot material used in Example 20.

The results of the above examples were compared and studied. As a result, it has been found that, in Comparative Examples 5 and 6, the peel area per unit period of time for the treatment is small and the amount of fine powder scattered is large, as compared to those in Examples 15 to 20. Further, it has been confirmed that, by blending the shot material of the present invention with a commercially available shot material, the peel effect is further improved.

EXAMPLE 21

A runner material for IC encapsulation material (epoxy resin content: 10% by weight; silica content: 80% by weight) discharged from a semiconductor assembling plant was ground and classified so that the particle size became 500 to 850 μm. Using the resultant material as a shot material, a used CD film (acryl-coated Al film) was subjected to peel treatment by means of a direct-pressure sandblasting machine for 10 seconds, and the surface state (peel area) was measured.

EXAMPLE 22

A used CD film was subjected to blasting treatment in substantially the same manner as in Example 21 except that 60% by weight of spherical silica was added to 40% by weight of a glass epoxy substrate and the resultant blend was mixed, ground, and classified so that the particle size became 500 to 850 μm.

EXAMPLE 23

A used CD film was subjected to blasting treatment in substantially the same manner as in Example 21 except that a commercially available resin shot material (melamine-based; particle size: 500 to 850 μm) was blended in an amount of 50% with the shot material in Example 21.

EXAMPLE 24

A used CD film was subjected to blasting treatment in substantially the same manner as in Example 21 except that a commercially available resin shot material (nylon-based; particle size: 500 to 850 μm) was blended in an amount of 30% with the shot material in Example 22.

COMPARATIVE EXAMPLE 7

A used CD film was subjected to blasting treatment in substantially the same manner as in Example 21 except that the commercially available resin shot material used in Example 23 was solely used.

COMPARATIVE EXAMPLE 8

A used CD film was subjected to blasting treatment in substantially the same manner as in Example 21 except that the commercially available resin shot material used in Example 24 was solely used.

The results of the above examples were compared and studied. As a result, it has been found that, in Comparative Examples 7 and 8, the peel area per unit period of time for the treatment is small and the amount of fine powder scattered is large, as compared to those in Examples 21 to 24. Further, it has been confirmed that, by blending the shot material of the present invention with a commercially available shot material or used resin waste, the peel effect is improved.

INDUSTRIAL APPLICABILITY

According to the present invention, ion-exchange resin waste or sludge discharged from a plant, which has conventionally not been effectively utilized, can be reused. In addition, the used resin (C), which is comprised of the resin (A) containing a rubber component and the resin (B) containing no rubber component, can be utilized. Further, a mixture of an epoxy resin composition and inorganic filler, typically a used encapsulation material, which has conventionally not been effectively utilized, can be reused. Thus, by the present invention, effective utilization of resources can be achieved and waste is reduced. Further, the use of the shot material of the present invention improves the blasting treatment. That is, the present invention not only improves the blasting treatment in working efficiency but also significantly contributes to protection of the environment.

The invention claimed is:

1. A blasting method comprising the step of blasting a shot material that comprises a styrene ion-exchange resin.

2. The blasting method according to claim 1, wherein the amount of said styrene ion-exchange resin in said shot material is at least 0.1% of the total weight of said shot material.

3. The blasting method according to claim 1 wherein said styrene ion-exchange resin is a recycled material.

4. The blasting method according to claim 1, wherein said shot material further comprises at least one material selected from the group consisting of a thermosetting resin, a thermoplastic resin, a biodegradable polymer, a metal, a metal oxide, a metal hydroxide, a metal salt, ceramic, and carbon black.

5. A method of blasting comprising the step of conducting the blasting method with a shot material that comprises a reprocessed waste material comprising a styrene ion-exchange resin.

* * * * *